US009735473B2

(12) United States Patent
Wang et al.

(10) Patent No.: US 9,735,473 B2
(45) Date of Patent: Aug. 15, 2017

(54) COMPACT RADIATION STRUCTURE FOR DIVERSITY ANTENNAS

(75) Inventors: Dong Wang, Waterloo (CA); Qinjiang Rao, Waterloo (CA); James Paul Warden, Irving, TX (US)

(73) Assignee: BlackBerry Limited, Waterloo, Ontario (CA)

( * ) Notice: Subject to any disclaimer, the term of this patent is extended or adjusted under 35 U.S.C. 154(b) by 574 days.

(21) Appl. No.: 13/823,723

(22) PCT Filed: Sep. 17, 2010

(86) PCT No.: PCT/US2010/049249

§ 371 (c)(1),
(2), (4) Date: Jul. 2, 2013

(87) PCT Pub. No.: WO2012/036694

PCT Pub. Date: Mar. 22, 2012

(65) Prior Publication Data

US 2013/0285867 A1 Oct. 31, 2013

(51) Int. Cl.
*H01Q 13/10* (2006.01)
*H01Q 1/24* (2006.01)
(Continued)

(52) U.S. Cl.
CPC ..... *H01Q 13/10* (2013.01); *H01Q 1/246* (2013.01); *H01Q 5/371* (2015.01); *H01Q 5/378* (2015.01);
(Continued)

(58) Field of Classification Search
USPC ..... 343/700 MS, 702, 795, 770, 843
See application file for complete search history.

(56) References Cited

U.S. PATENT DOCUMENTS 6,337,670 B1 * 1/2002 Chen ..... H01Q 1/24 343/700 MS
7,113,135 B2 * 9/2006 Jo ..... H01Q 1/242 343/700 MS
(Continued)

FOREIGN PATENT DOCUMENTS

CN 1659743 A 8/2005
CN 1898837 A 1/2007
(Continued)

OTHER PUBLICATIONS

Office Action mailed Sep. 11, 2014; in corresponding Canadian patent application No. 2,807,722, 2014.
(Continued)

*Primary Examiner* — Hoang Nguyen
*Assistant Examiner* — Hai Tran
(74) *Attorney, Agent, or Firm* — Fish & Richardson P.C.

(57) ABSTRACT

An antenna for diversity operation comprising a plurality of connected antenna units (100). The antenna units each having a first radiation element (102) with length of a quarter of a wavelength at a first operating frequency a second radiation element (104) with length of a quarter of a wavelength at a second operating frequency distinct from the first operating frequency, the second radiation element sharing with the first radiation element a segment of the first radiation element. A feed point for coupling a feed to one of said first or second radiation elements such that the elements resonate at the first and second operating frequencies respectively and at substantially orthogonal polarizations. Diversity antennas configured with two or more of the antenna units.

16 Claims, 7 Drawing Sheets

(51) Int. Cl.

| | |
|---|---|
| ***H01Q 9/30*** | (2006.01) |
| ***H01Q 9/46*** | (2006.01) |
| ***H01Q 21/24*** | (2006.01) |
| ***H01Q 21/30*** | (2006.01) |
| ***H01Q 5/371*** | (2015.01) |
| ***H01Q 5/378*** | (2015.01) |

(52) U.S. Cl.
CPC ..... *H01Q 9/30* (2013.01); *H01Q 9/46* (2013.01); *H01Q 21/24* (2013.01); *H01Q 21/30* (2013.01)

(56) References Cited

U.S. PATENT DOCUMENTS

| | | | | |
|---|---|---|---|---|
| 7,355,559 | B2 * | 4/2008 | Tikhov | H01Q 1/38 343/700 MS |
| 7,446,714 | B2 * | 11/2008 | Biddulph | 343/700 MS |
| 2001/0002823 | A1 | 6/2001 | Ying | |
| 2004/0246188 | A1 | 12/2004 | Egashira | |
| 2005/0001777 | A1 * | 1/2005 | Suganthan | H01Q 5/371 343/795 |
| 2006/0258289 | A1 * | 11/2006 | Dua | G06F 17/30058 455/41.3 |
| 2007/0182638 | A1 | 8/2007 | Rowell | |
| 2008/0143602 | A1 * | 6/2008 | Mak | H01Q 3/24 342/374 |
| 2008/0180333 | A1 * | 7/2008 | Martiskainen | H01Q 1/243 343/722 |
| 2009/0174611 | A1 | 7/2009 | Schlub et al. | |

FOREIGN PATENT DOCUMENTS

| | | | |
|---|---|---|---|
| CN | 101090176 | A | 12/2007 |
| CN | 201188448 | Y | 1/2009 |
| CN | 101361282 | | 2/2009 |
| CN | 201430211 | | 3/2010 |
| CN | 201508899 | U | 6/2010 |
| CN | 101834345 | | 9/2010 |
| DE | 3732994 | A1 | 4/1989 |
| DE | 4102845 | A1 | 8/1992 |
| FR | 2925233 | | 6/2009 |

OTHER PUBLICATIONS

International Search Report mailed Feb. 14, 2011; in corresponding PCT patent application No. PCT/US2010/049249, 2010.
Office Action mailed Dec. 1, 2014; in Chinese patent application No. 201080069131.5, 2010.
English abstract for CN1659743; published on Aug. 24, 2005 and retrieved on Dec. 5, 2014, 2005.
English abstract for CN1898837; published on Jan. 17, 2007 and retrieved on Dec. 5, 2014, 2007.
English abstract for CN101090176; published on Dec. 19, 2007 and retrieved on Dec. 5, 2014, 2007.
English abstract for CN201188448; published on Jan. 28, 2009 and retrieved on Dec. 5, 2014, 2009.
English abstract for CN201508899; published on Jun. 16, 2010 and retrieved on Dec. 5, 2014, 2010.
English translation of the Office Action mailed Dec. 1, 2014; in Chinese patent application No. 201080069131.5, 2010.
Office Action issued in Chinese Application No. 201080069131.5 on Mar. 16, 2015; 4 pages, 2010.
Translation of Office Action issued in Chinese Application No. 201080069131.5 on Mar. 16, 2015; 6 pages, 2010.
First Office Action mailed Apr. 30, 2014; in corresponding Chinese patent application No. 201080069131.5, 2014.
English translation of the First Office Action mailed Apr. 30, 2014; in corresponding Chinese patent application No. 201080069131.5, 2014.
Machine translation for CN101361282; published on Feb. 4, 2009, 2009.
Machine translation for CN101834345; published on Sep. 15, 2010, 2010.
Machine translation for CN201430211; published on Mar. 24, 2010, 2010.
English translation of the First office Action mailed Jun. 10, 2014; in corresponding Chinese patent application No. 201080069131.5, 2014.
The International Search report and the Written Opinion of the International Searching Authority mailed Feb. 14, 2011, in corresponding PCT patent application No. PCT/US2010/049249, 2011.
Communication Pursuant to Article 94(3) EPC issued in EP Application No. 10769106.5 on Jul. 14, 2015; 5 pages.

* cited by examiner

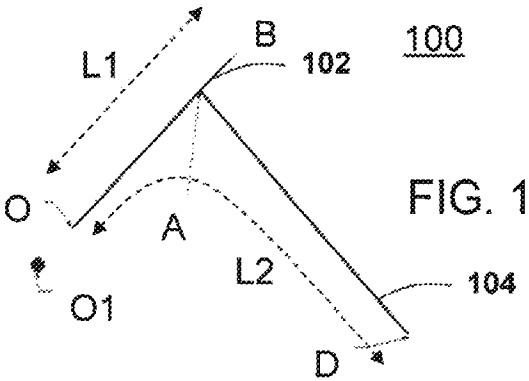
FIG. 1
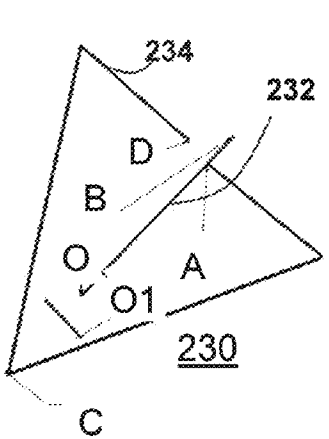
FIG. 2a
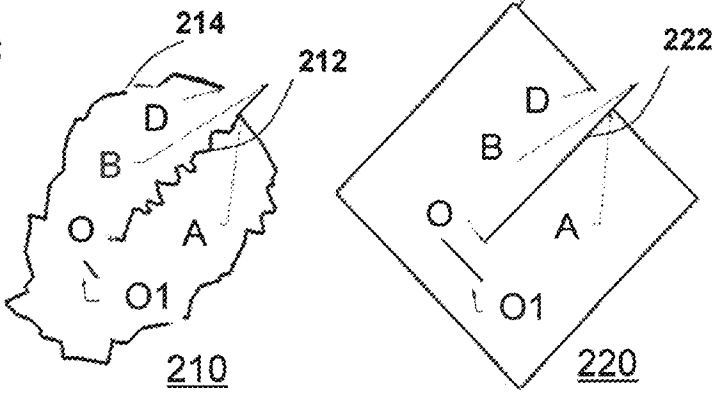
FIG. 2b
FIG. 2c
FIG. 2d

304
O1
202
O
A
D
B
C
204
204
202
300
302

O1
400
P1
P2
P3
P4
O
A

P1
P2
P5
P3
P4
h
306
310
312

P5
308
412

202
204
500
P5

P5
204
502
202

FIG. 7a
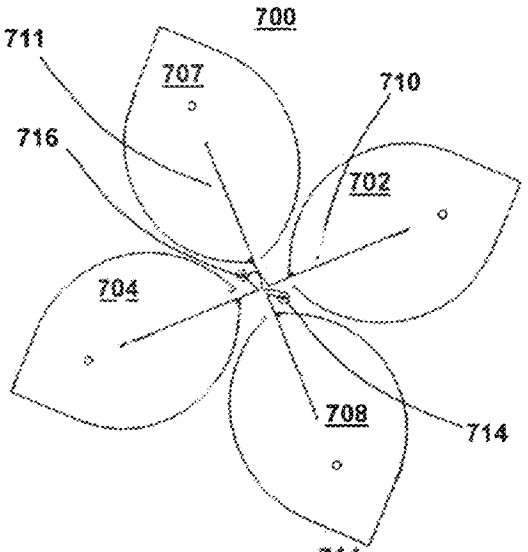
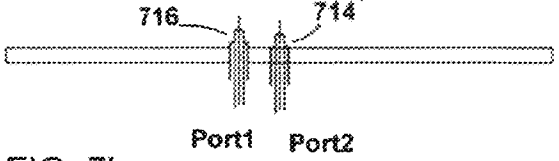
FIG. 7b
FIG. 6a
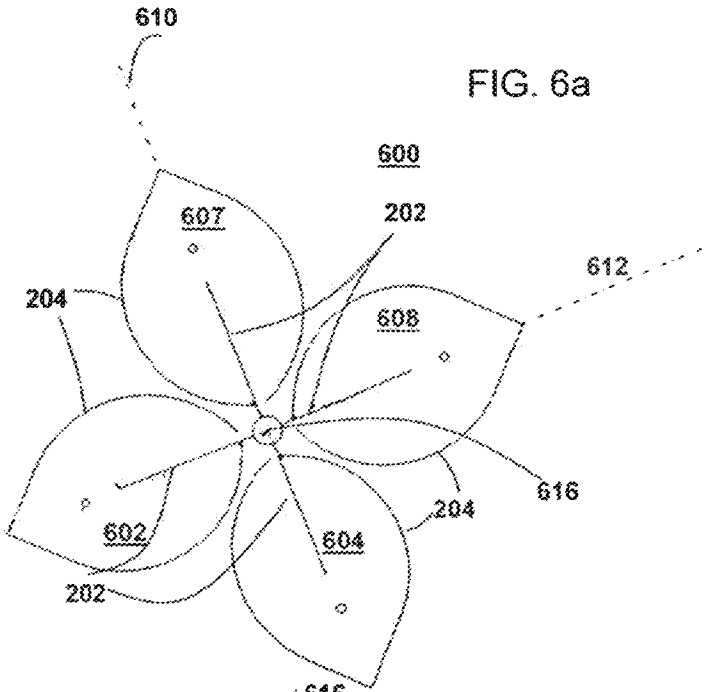
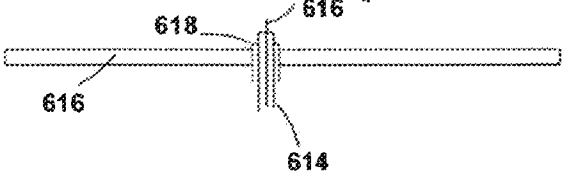
FIG. 6b

COMPACT RADIATION STRUCTURE FOR DIVERSITY ANTENNAS

FIELD OF THE DISCLOSURE

The present invention relates to the field of communications systems, and, more particularly, to base station antennas for mobile wireless communications and related methods.

BACKGROUND

Antenna diversity techniques utilize two or more antennas to improve the quality and reliability of signals received or transmitted over a wireless link. A majority of wireless environments are urban environments in which signals are reflected along multiple paths before finally being received. Each of these bounces can introduce phase shifts, time delays, attenuations, and even distortions that can destructively interfere with one another at the aperture of a receiving antenna. Antenna diversity is especially effective at mitigating these multipath situations.

Furthermore antenna diversity allows the capacity of the system to be increased by using different bands or spatial regions within which to send or receive signals—for example by allocating different spatial regions for different channels allows the reuse of the same frequency band. Thus, antenna diversities (frequency, polarization, radiation pattern and spatial) are being explored for current and future multiple antenna smart wireless communication systems, such as LTE (long term evaluation) and MIMO (multiple input and multiple output).

Cellular standards like the third generation partnership program (3GPP) long term evolution (LTE), ultra-mobile broadband (UMB), high speed downlink packet access (HSDPA) and IEEE 802.16e (WiMAX) support multiple-input multiple-output (MIMO) wireless communication technology. MIMO uses multiple antennas at the transmitter and receiver along with advanced digital signal processing to improve link quality and capacity. Existing base stations use antenna arrays to provide transmit and receive diversity Recently, studies on microstrip antennas have focused on frequency reuse and polarization diversity of the two-orthogonal polarizations to double the capacity of communication systems and reduce the multi-path fading of received signals in land-based mobile communications.

Moreover, dual-frequency microstrip antenna arrays, often realized through a multilayer architecture, have gained considerable interest. However, there have been some inherent challenges in the design and architecture of dual-polarized dual-frequency band microstrip antenna arrays.

Conventionally, a dual-polarized microstrip antenna is realized by feeding a patch at the two orthogonal edges. This feeding approach requires two feeding-networks for two individual polarization components, respectively. But it is difficult to allocate enough space to accommodate two sets of feeding networks if a dual-polarized array is to be employed within a limited allowable space. Strong mode coupling and high cross polarization is likely to occur. This problem exacerbated if active and passive circuits are required to be integrated into the feed-networks.

Furthermore, if a dual-frequency operation for the above dual-feed dual-polarized array is realized by multilayered architecture, the size and complexity of the array will be further increased.

Designers of antennas for mobile communications face significant challenges, particularly since antennas must be capable of covering as many bands as possible while being small in size and still having a high performance.

BRIEF DESCRIPTION OF THE DRAWINGS

The present disclosure will be better understood with reference to drawings in which:

FIG. 1 shows a plan view of a basic configuration of a dual frequency antenna unit according to an embodiment of the present matter;

FIGS. 2*a-d* shows respectively plan views of a leaf, meander line, square and triangle configuration of the antenna unit of FIG. 1;

FIGS. 6*a-b* show respectively a plan and side view of a single port dipole diversity antenna configuration using the dual frequency antenna unit according to a further embodiment of the present matter;

FIGS. 7*a-b* show respectively a plan and side view of a two port dipole diversity antenna according to another embodiment of the present matter;

DETAILED DESCRIPTION

Figures 3A, 3B, 4A, 4B, 5A, 5B:
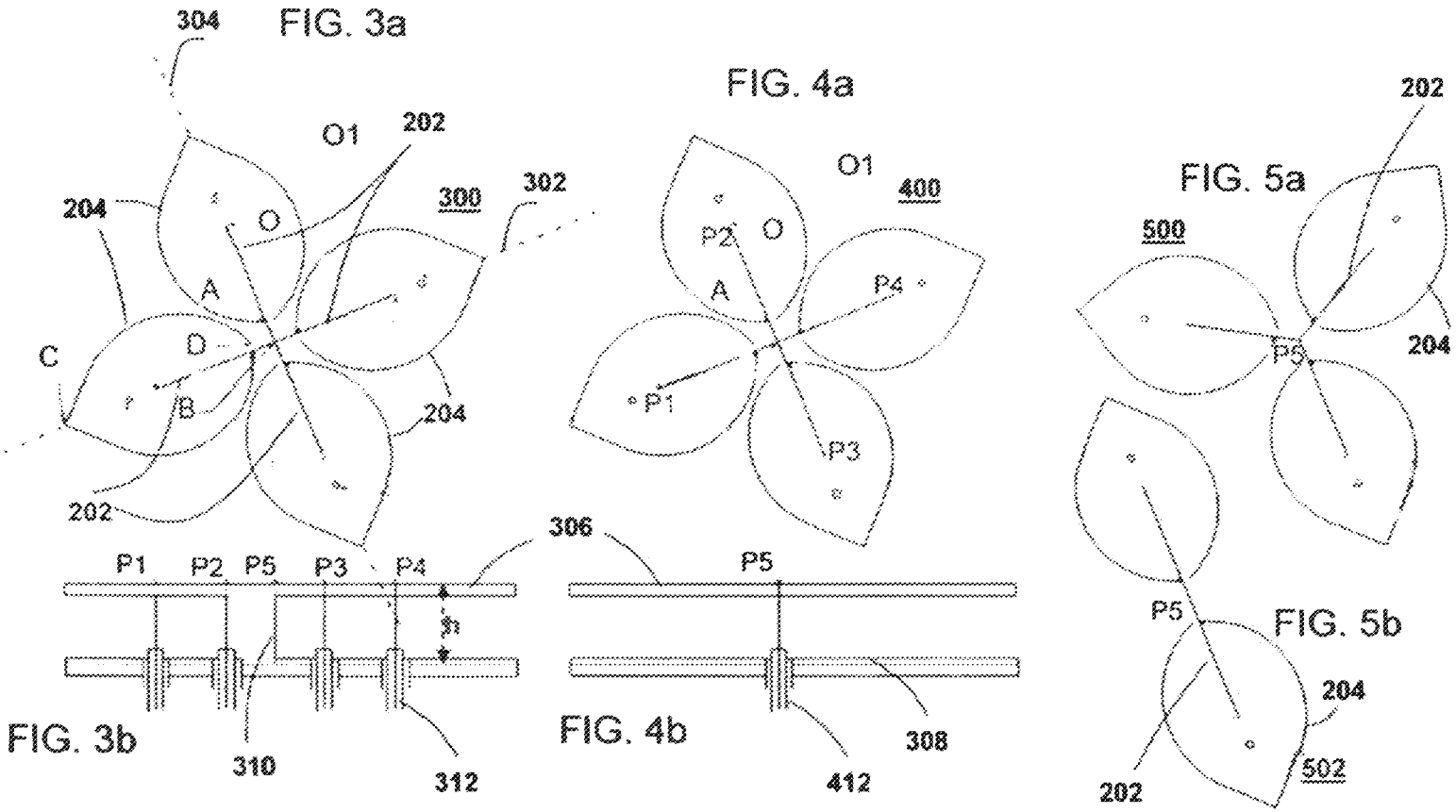
FIGS. 3*a-b* show respectively a plan and side view of a multiport diversity antenna configuration using the dual frequency antenna unit according to an embodiment of the present matter.
FIGS. 4*a-b* show respectively a plan and side view of a single port diversity antenna configuration using the dual frequency antenna unit according to a still further embodiment of the present matter
FIGS. 5*a-b* show plan views of further configurations of the diversity antenna of FIG. 3 and FIG. 4.

In the following description like numerals refer to like structures illustrated in the drawings. It is to be noted that the term radiation as used herein is non directional and implies a capability of both transmission and reception unless otherwise stated.

In accordance with an aspect of the present matter there is provided an antenna for diversity operation comprising a plurality of connected antenna units. The antenna units each having a first radiation element with length of a quarter of a wavelength at a first operating frequency a second radiation element with length of a quarter of a wavelength at a second operating frequency distinct from the first operating frequency, the second radiation sharing with the first conductor a segment of the first conductor. A feed point for coupling a feed to one of said first or second radiation elements such that the elements resonate at the first and second operating frequencies respectively and at substantially orthogonal polarizations.

In accordance with a further aspect the first radiation element is a straight line having first and second ends and the second radiation element is arranged with an open end partially encircling the first radiation element.

In a further aspect the antenna includes a parasitic element arranged in proximity to the first end of the first radiation element.

In a further aspect the radiation elements are conductors and in another aspect the radiation elements are slots.

In a still further aspect a four port antenna diversity monopole antenna is configured with the plurality of antenna units formed on a substrate arranged with their first conductors connected together at a common connection point at the respective second ends, the antenna units so connected are symmetric relative to at least one symmetry axes and the substrate is spaced from a common ground plane. In a still further aspect a single port polarization diversity dipole antenna is configured with two pairs of antenna units formed on a substrate and arranged to be symmetric relative to at least one symmetry axes with each of the pairs having their respective second ends connected for forming a feed point.

In a still further aspect a dual port polarization diversity dipole antenna is configured with two pairs of antenna units formed on a substrate and arranged with antennas in a pair along respective crossing axis, with respective pairs (along the same axis) having their second ends connected to a feed.

Referring to FIG. 1 there is shown schematically a basic configuration of a dual frequency antenna unit 100 according to an embodiment of the present matter. In this embodiment, the antenna unit 100 has a pair of wireline conductors 102 and 104 comprising the two radiation elements formed on a surface of suitable planar substrate (not shown) such as FR4. The wireline conductors are etched, painted or otherwise formed upon the substrate. The pair of wireline conductors 102 and 104 are formed with different physical lengths L1 and L2 each corresponding to about a quarter (¼) wavelength of a desired operating frequency at the fundamental or dominant mode. The dual operating frequencies are usually the respective resonant frequencies when exciting the antenna in its fundamental mode. It is to be noted that with coupling the lengths may be a little longer or shorter than a ¼ wavelength and the electrical length of the conductors change with different operating modes, also the electrical length is different for higher modes of operation. The first conductor 102 has first and second ends labeled O and B respectively. The second conductor 104 has third and fourth ends labeled O and D respectively. The second conductor 104 extends from the first conductor 102 at a position labeled A such that the first and second conductors 102,104 share a portion of their lengths i.e. O-A or B-A depending on the particular configuration (described later). The second conductor 104 is arranged upon the substrate having its fourth end D extending away from the first conductor 102. The position of A is generally closer to the end B and is usually determined at design time using a suitable simulator as is known in the art.

A feed connection may be made at one of the ends O, B and D of the conductors or at a position along the length of the conductors 102, 104, depending on the particular application as will be discussed below.

A shorting pin (not shown) to a ground conductor may be connected at one of the ends O, B, D or A of the radiating conductors 102, 104 depending on the particular application as will be discussed below.

A patch element O1 may be arranged, again depending on the application, on the surface of the substrate 106 in a region proximate one of the ends of the conductors, preferably at the first end O. The patch O1 behaves as parasitic element and has one of different geometries, such as a line, rectangle or circle depending on a desired response for the antenna. The configuration and placement of the patch element O1 is usually modeled and determined at design time based on a particular response desired.

The antenna unit 100 may be used with or without a ground conductor depending on the application and the feed arrangement as will be described later.

The resonant frequencies of the antenna unit may be easily changed by changing the physical lengths of the conductors 102, 104.

In the exemplary implementation, the first conductor 102 is a straight line and the second conductor 104 is arranged with its open end D partially encircling the first conductor 102 as shown in FIG. 2*a-d*. This provides a more compact antenna arrangement and allows two or more of the antenna units 100 to be configured into an array, or into a diversity antenna configuration disposed upon a generally planar substrate, of dimensions permitting its positioning within a housing of limited volume.

In the present description radiation element traces are referred to for convenience however the present description also applies equally well if the radiation element traces are replaced with slots etched into a metal plate, having the same shapes as the traces. In other words the electrical dipoles and monopoles described herein could as well be implemented as magnetic dipoles or monopoles.

Referring now to FIG. 2*a*, there is shown an embodiment of the antenna unit 200 wherein the first conductor is a straight line 202 and the second conductor 204 is a curve, taking on the appearance of a leaf. FIG. 2*b* illustrates another embodiment of the antenna unit 210 wherein the first 212 and second 214 conductors are meander lines, which allow an increase in electrical length of the conductors. FIG. 2*c* illustrates a further embodiment 220 of the antenna unit wherein the first conductor 222 is a straight line and the second conductor 224 forms a rectangle or square shape around a portion of the first conductor 222 and FIG. 2*d* illustrates a still further embodiment 230 of the antenna unit wherein the second conductor 234 is triangular in shape with an apex of the triangle on an axis extending through the first conductor 232.

The antenna units 100, 200, 210, 220 and 230 may be used to construct various diversity antennas. Specifically the antenna units are arranged in a somewhat star like configuration with various combinations of feed points, ground plane and shorting pins to form a variety of diversity antennas as described below. For ease of description, the antenna unit 200 will be used to exemplify various diversity configurations below.

Referring now to FIG. 3*a* and FIG. 3*b*, there is shown a dual frequency diversity antenna 300 configured with four interconnected antenna units 200. As shown in the plan view of FIG. 3*a* the four antenna units 200 are arranged with their straight line conductors OB connected together at a common respective second ends B such that the antenna units so connected are symmetric relative to two mutually orthogonal symmetry axes 302, 304. The diversity antenna 300 is formed on a substrate 306 and spaced from a common ground plane 308 as illustrated in the side view FIG. 3*b*. Feeds P1, P2, P3 and P4 are connected to each of the respective first ends O of the antenna units and a shorting pin 310 is connected from the common second end B at a common connection point P5 to ground. The ground plane in this configuration defines a reflector that is separated from the conductive elements that are disposed upon the substrate 306 and separated by an air gap of distance h. In the embodiment, coaxial or similar connectors 312 are positioned in the substrate upon which the ground plane 308 is formed with their center conductors connected to the respective feeds P1, P2, P3 and P4. In this configuration the antenna 300 is a four feed (four port) dual frequency diversity antenna. The air gap between the end D of the second conductors and the first conductors in the region A provides capacitive coupling between the two ends of the gap. The spacing of the gap may be optimized during simulation so that it has reasonable values for different operating bands. Similarly the air gap h may also be optimized.

In a further embodiment (not shown) which is a variation of the embodiment of FIG. 3, the common connection point P5 may be left open or a matching network with lumped elements may be connected to it.

Referring to FIG. 4*a* and FIG. 4*b* there is shown plan and side views, respectively of a still further embodiment of a diversity antenna 400. The diversity antenna 400 is configured with four antenna units 200, similar to the diversity antenna 300 shown in FIG. 3; however the shorting pin 310 of FIG. 3 is instead replaced by a single feed (single port) at the common connection point P5 and the ground plane 308. The remaining connections P1, P2, P3 and P4 are left open. Accordingly, in this configuration the antenna 400 is a single feed dual polarization monopole antenna with four cross arms. Thus the diversity antenna 400 provides two dual frequency crossing monopoles with a shared feed.

Referring to FIGS. 5*a* and 5*b* there is shown configurations of diversity antennas comprising two antenna units and three antenna units, respectively for which a feed configuration similar to FIG. 3 or 4 may be implemented.

Referring to FIGS. 6*a* and 6*b* there is shown respective top and side views of a dual-band crossing dipole antennas 600 configured with two pairs 602, 604 and 607, 608 of interconnected antenna units 200 for providing a polarization diversity antenna 600. The antenna units are arranged upon a substrate 606 to be symmetric relative to two mutually orthogonal symmetry axes 610, 612. As illustrated in the side view FIG. 6*b*, a ground conductor is not employed and the feed connector 614 is connected with its central conductor 616 connected to adjacent pair of antenna units 602, 604 and the return or ground connection 618 is connected to the other pair of adjacent antenna units 607, 608. The diversity antenna 600 in this configuration operates as two dual-band crossing dipoles sharing a feed for polarization diversity.

Referring to FIGS. 7*a* and 7*b* there is shown respective top and side views of a two port dual polarization dipole antenna 700 according to a further embodiment of the present matter. As will be seen this antenna 700 is similar in configuration to the dipole antenna arrangement 600 configured with two pairs 702, 704 and 707, 708 of interconnected antenna units along two crossing axis 710, 711, except that the single feed is replaced with a two feed arrangement 714 and 716. The feeds 714 and 716 are connected to opposite pairs of antenna units to form two dipole antennas 704, 702 and 707, 708.

Figure 8:
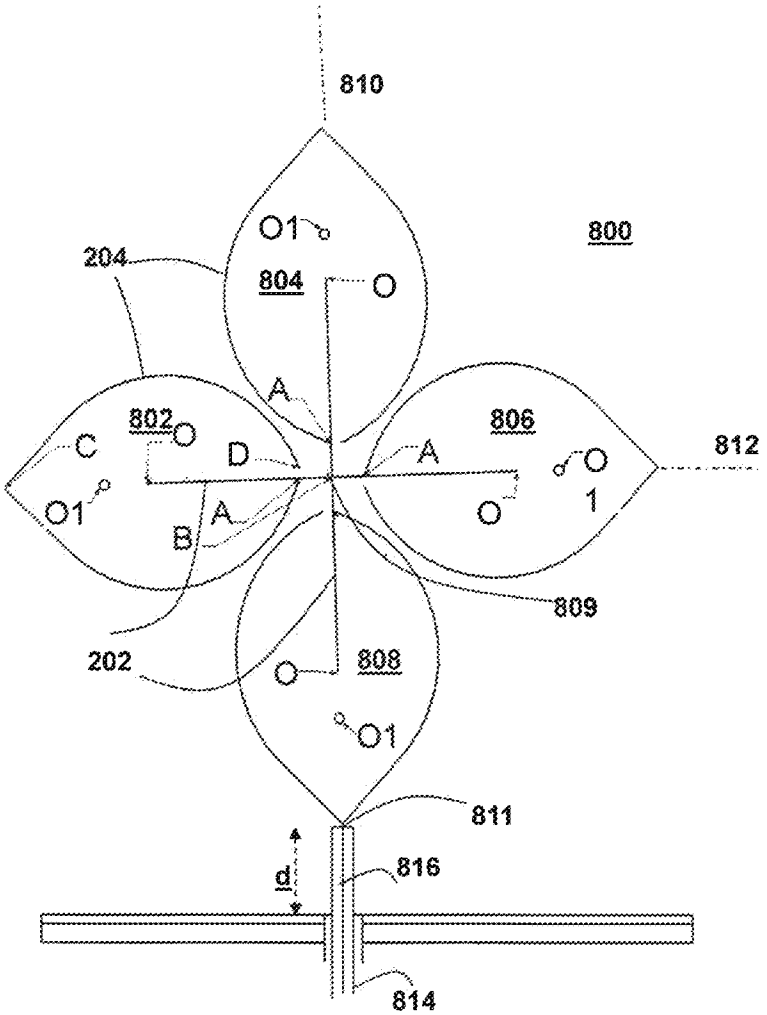
FIGS. 8*a-b* show respectively a plan and side view of a fourth diversity antenna configuration using the dual frequency antenna units according to another embodiment of the present matter.

Referring now to FIG. 8, there is shown a side view of a diversity antenna configuration for an ultra-wideband polarization diversity antenna 800. The ultra-wideband polarization diversity antenna 800 is configured with four interconnected antenna units 200, designated 802, 804, 807 and 808. The antenna units 200 are arranged upon a planar substrate (not shown) with their straight line conductors OB connected together at a common respective second ends B 809 to be symmetric relative to two mutually orthogonal symmetry axes 810, 812. The configured diversity antenna conductors are mounted over a plane of a ground conductor 813 and orthogonally thereto. A feed connector 814 is connected through the ground plane with its central conductor 816 connected to a feed point 811 on the second conductor 204 of one of the antenna units located at a point closest to the ground plane conductor. The ground plane 813 in this configuration defines a reflector that is separated from the conductive elements by a distance d measured from the closest point of the conductor 204 to the ground plane 813. As may be seen the antenna 800 radiates energy in both the horizontal and vertical planes and all planes in between. Thus the diversity antenna 800 provides ultra-wideband polarization diversity antenna.

As mentioned earlier, each of the antenna units may employ a parasitic element O1 for fine tuning of the radiation pattern of the diversity antenna by varying a length, width or diameter of the patch element.

Figure 9A:
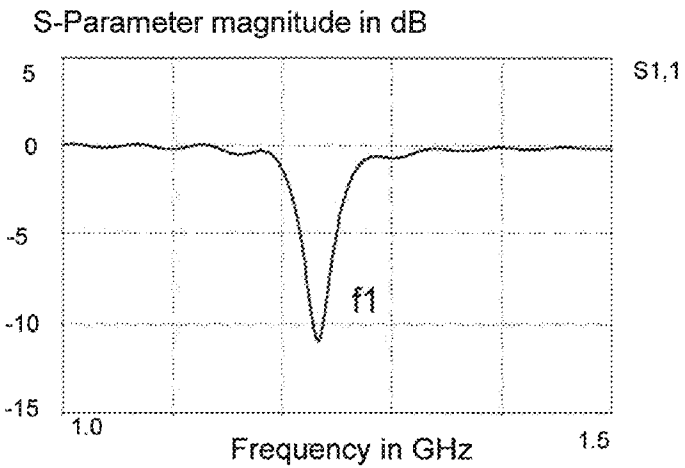
FIGS. 9*a-b* show graphs of a reflection parameter for the antenna of FIG. 4.
Figure 9B:
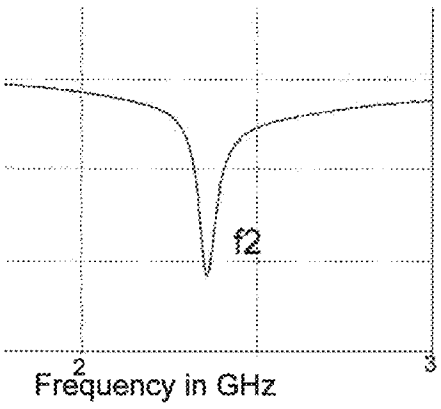

Referring to FIGS. 9*a* and 9*b* there is shown a plot of the s-parameter at each of the operating frequencies f1 and f2 for a single port multiband and multi polarization monopole corresponding to the antenna configuration 400 of FIG. 4.

Figure 10:
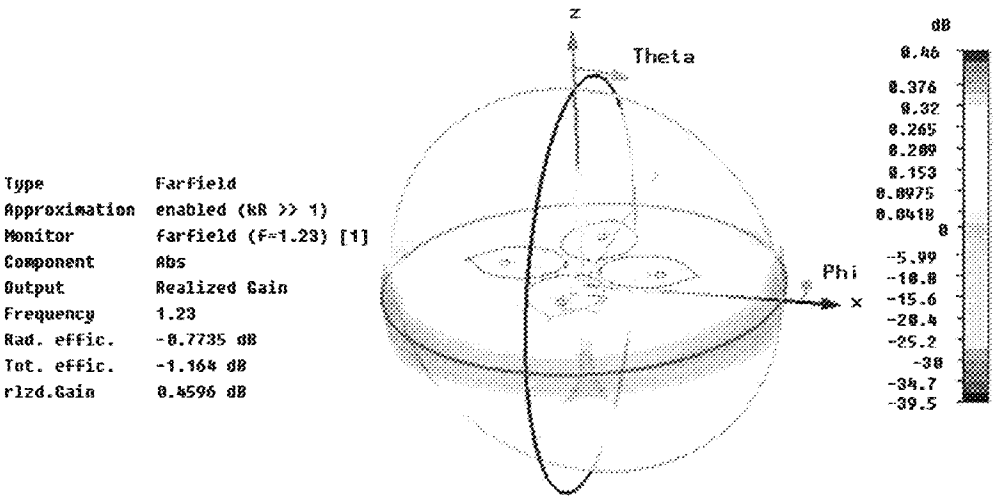
FIG. 10 shows a far field polarization pattern for the antenna of FIG. 4 at one of the dual-bands.

Referring to FIG. 10 there is shown a three dimensional for far field plot at one of the operation frequencies f1 of the antenna 400. As may be seen maximum gain occurs in a region encircling the antenna 400 in an x-y plane parallel to the plane of the substrate 306.

Figure 11A:
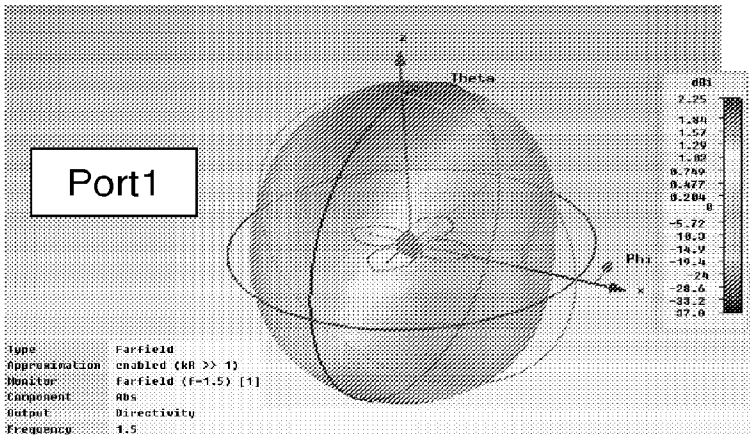
FIGS. 11*a-b* show far field polarization patterns of the antenna of FIG. 7 when the respective first and second ports are activated.
Figure 11B:
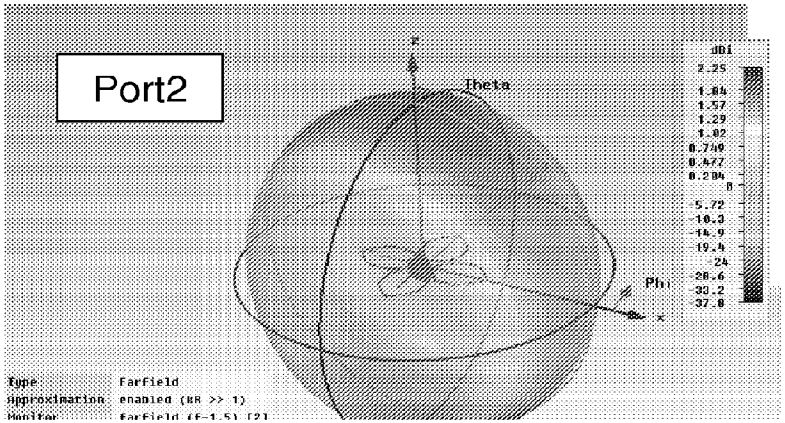

Referring to FIGS. 11*a* and 11*b* there is shown a three dimensional far field antenna gain plot for the respective dipoles of the antenna 700 of FIG. 7 without the parasitic elements. As is seen, the plots shows each of the dipoles have a polarization pattern along the axis (x and y) of the pairs of antennas forming the dipole. With a result that the diversity antenna 700 exhibits two polarizations which are mutually orthogonal i.e. in an x-z plane and a y-z plane.

While the above embodiments have been described with respect to the antenna unit 200 shown in FIG. 2*a*, it is understood that the other antenna unit arrangements may be used as for example shown in FIGS. 2*b-d*. Furthermore other numbers than four antenna units may be also be implemented without departing from the scope of the present matter. Thus it may be seen that the present antenna unit provides a compact radiation structure that may be used to configure various single or multiport diversity antennas which may be used in a wireless communication system. Furthermore, an advantage of the present matter is that the multiport arrangements may be directly fed without need for complex feed networks.

Figure 12:
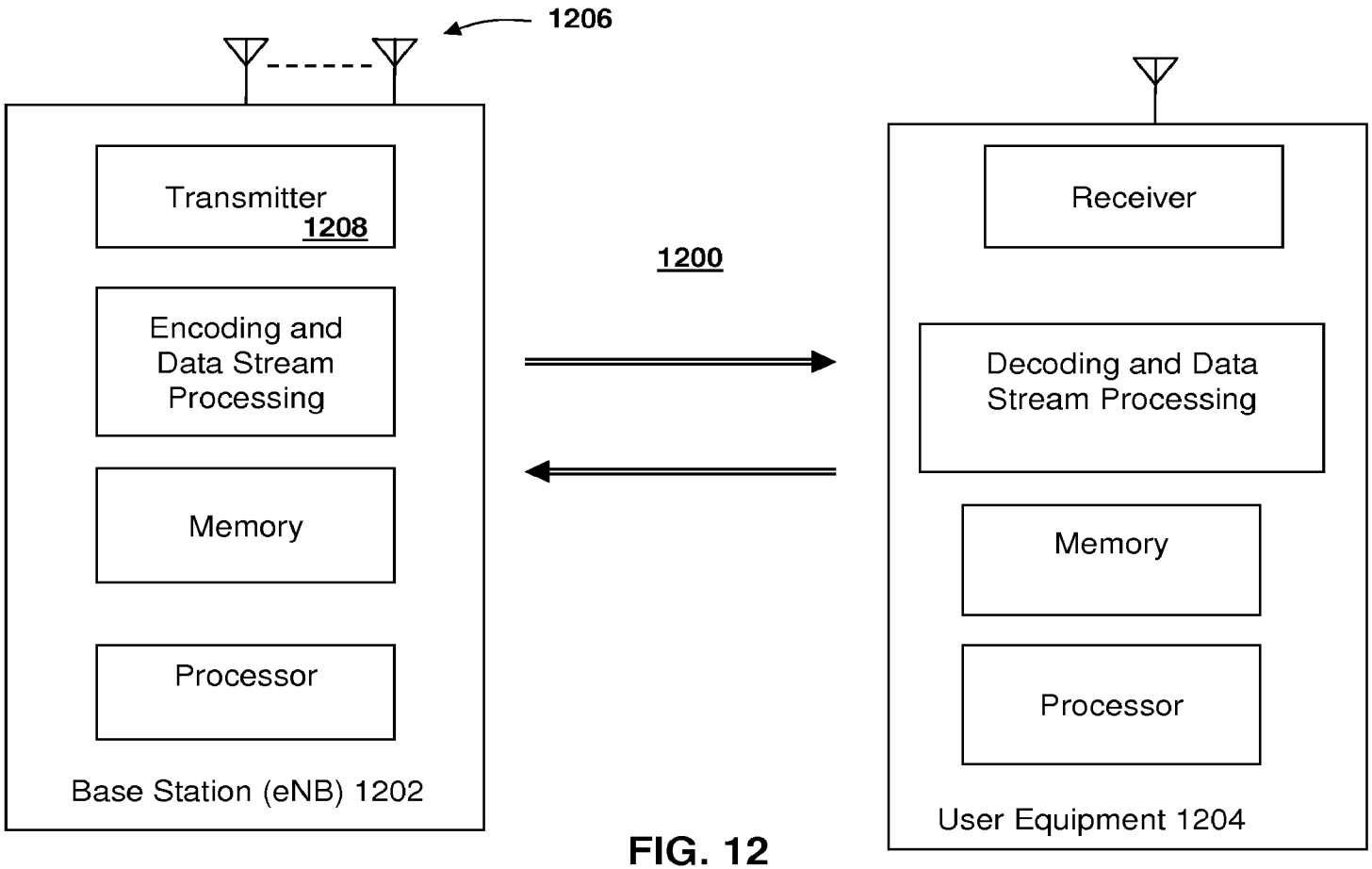
FIG. 12 shows a functional block diagram of a wireless communication system in which an embodiment of the present matter is operable.

Exemplary components of a wireless communications system 1200 in which one or more of the above-described antennas may be used are now described with reference to FIG. 12. The system can consist of multiple base stations (BS's) 1202 communicating with one or more mobile device 1204. The mobile devices 1204 may also have the capability to communicate with other computer systems on the Internet (not shown). Depending on the exact functionality provided, the mobile device 1204 that might be used by users in a wireless communications network can include both mobile terminals, such as mobile telephones, personal digital assistants, handheld computers, portable computers, laptop computers, tablet computers and similar devices, and fixed terminals such as residential gateways, televisions, set-top boxes and the like. Such devices are referred to as user equipment or UE 1204.

The transmission equipment in the base station 1202 transmits signals throughout a geographical region sometime defined as a cell. Advanced network access equipment might include, for example, an enhanced node-B (eNB)

rather than a base station or other systems and devices that are more highly evolved than the equivalent equipment in a traditional wireless telecommunications system. Such advanced or next generation equipment is typically referred to as long-term evolution (LTE) equipment.

The BS 1202 may include a multi-antenna 1206 arrangement according to one or more embodiments of the present matter, coupled to a transmitter 1208 part of an RF interface that may be used to communicate with the UEs via for example an OFDM MIMO air interface, although the embodiments are not limited in this respect. The BS 1202 and the UE 1204 may include elements similar to existing communication devices such as coding/modulation or detection/demodulation logic, Fast Fourier Transform (FFT)/Inverse FFT logic, and/or other components as suitably desired.

The BS or the UE could include MAC processor that communicates with RF interface to process receive/transmit signals and may include an analog-to-digital converter for down converting received signals, a digital-to-analog converter for up converting signals for transmission, and optionally, a baseband processor for physical link layer processing of respective receive/transmit signals. A MAC processor could perform medium access control and data link layer processing. Further, a MAC processor would include an uplink scheduler, in combination with additional circuitry such as buffer memory scheduling buffer. The MAC processor and scheduling buffer may function to queue, dequeue or otherwise schedule MAC Source Data Units (SDUs) for uplink transmission to the BS.

An implementation of the BS includes precoding and beam-forming logic to maximize the signal level. Beam forming implies that multiple antennas 1206 are used to form the transmission or reception beam; in this way, the signal-to-noise ratio at the UE is decreased. This technique can both be used to improve coverage of a particular data rate and to increase the system spectral efficiency. Thus, beam forming can be applied to both the downlink and the uplink. The UE 1204 can report the channel state information (CSI) back to the base station to use for subsequent transmissions. In a closed-loop beam-forming MIMO system, the BS utilizes the channel information feedback from the UE to form a beam towards the UE using precoding weights (e.g., a pre-coding matrix extracted from a channel matrix).

At the BS 1202, various polarization arrays may be used depending on the transmission strategies employed. Furthermore optimization procedures may be used to determine values for the antenna parameters like inter-element spacing, cross-polarization isolation and port-to-port isolation.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

The invention claimed is:

1. An antenna for diversity operation comprising:

a plurality of connected antennas each connected antenna having:

a first antenna with length of a quarter of a wavelength at a first operating frequency;

a second antenna with length of a quarter of a wavelength at a second operating frequency distinct from said first operating frequency, the second antenna sharing with said first antenna a segment of a conductor; and a common feed point connected to said first or said second antennas such that said first antenna and said second antenna resonate at said first and second operating frequencies respectively and at least two of said connected antennas configured to have substantially orthogonal polarizations; wherein the first antenna is a straight line having first and second ends and the second antenna is arranged with an open end partially encircling the first antenna; and wherein the plurality of connected antennas are formed on a substrate, the first antennas of each of the plurality of connected antennas being connected together at a common connection point at the respective first ends of the first antenna, the plurality of connected antennas so connected being symmetric relative to at least one symmetry axis and wherein the substrate is spaced from a common ground plane.

2. The antenna of claim 1 wherein the second antenna is a meander line.

3. The antenna of claim 1 wherein the second antenna forms a perimeter of a rectangle around a portion of the first antenna.

4. The antenna of claim 1 wherein the second antenna forms a perimeter of a triangle around a portion of the first antenna.

5. The antenna of claim 1 including a parasitic element arranged in proximity to a first end of said first antenna.

6. The antenna of claim 5 said parasitic element geometric configuration being selected from one of a line, rectangle or circle.

7. The antenna of claim 1, including a plurality of feed points each located at said first end of each of the respective plurality of antennas.

8. The antenna of claim 7, including a shorting pin connected from said common connection point to said ground plane.

9. The antenna of claim 7, said plurality of antennas are formed on the substrate being arranged with their first antennas connected at a common connection point at respective first ends, the antennas so connected are symmetric relative to the at least one symmetry axis, said substrate being mounted orthogonally to a plane of a ground conductor; and said feed point being at a first or second antenna of one of the antennas closest proximity to the ground plane conductor.

10. The antenna of claim 1, wherein said feed point is located at said common connection point.

11. The antenna of claim 1 having two pairs of antennas formed on the substrate and arranged to be symmetric relative to the at least one symmetry axis with each of said pairs having their respective ends connected for forming said feed point.

12. The antenna of claim 1, wherein the first and second antennas are conductors.

13. The antenna of claim 1, wherein the first and second antennas are slots.

14. A wireless communication system comprising an antenna as claimed in claim 1.

15. The antenna of claim 1, wherein the first and second antennas are a combination of slots and conductors.

16. An antenna for diversity operation comprising:

a plurality of connected antennas each connected antenna having:

a first antenna with length of a quarter of a wavelength at a first operating frequency;

a second antenna with length of a quarter of a wavelength at a second operating frequency distinct from said first operating frequency, the second antenna sharing with said first antenna a segment of a conductor; and a common feed point connected to said first or said second antennas such that said first antenna and said second antenna resonate at said first and second operating frequencies respectively and at least two of said connected antennas configured to have substantially orthogonal polarizations; wherein the first antenna is a meander line having first and second ends and the second antenna is arranged with an open end partially encircling the first antenna; and wherein the plurality of connected antennas are formed on a substrate, the first antennas of each of the plurality of connected antennas being connected together at a common connection point at the respective first ends of the first antenna, the plurality of connected antennas so connected being symmetric relative to at least one symmetry axis and wherein the substrate is spaced from a common ground plane.

* * * * *